US008540553B2

(12) United States Patent
Bagley

(10) Patent No.: US 8,540,553 B2
(45) Date of Patent: Sep. 24, 2013

(54) PORTABLE POWER SHARPENER FOR HAND HELD ROTARY CUTTER BLADES

(76) Inventor: Jim Bagley, Bluffdale, UT (US)

( * ) Notice: Subject to any disclaimer, the term of this patent is extended or adjusted under 35 U.S.C. 154(b) by 456 days.

(21) Appl. No.: 12/914,620

(22) Filed: Oct. 28, 2010

(65) Prior Publication Data

US 2012/0108150 A1 May 3, 2012

(51) Int. Cl.
*B24B 23/00* (2006.01)

(52) U.S. Cl.
USPC ..... 451/324; 451/349; 451/451

(58) Field of Classification Search
USPC ..... 76/85; 451/45, 324, 321, 327, 371, 451/398, 451, 349
See application file for complete search history.

(56) References Cited

U.S. PATENT DOCUMENTS

| | | | | |
|---|---|---|---|---|
| 1,165,342 | A | 12/1915 | Peterson | |
| 2,728,176 | A | 6/1952 | Ritzert | |
| 2,721,430 | A * | 10/1955 | Green et al. | 451/422 |
| 3,315,452 | A | 4/1967 | Rossi | |
| 3,979,857 | A * | 9/1976 | Kobylarz | 451/293 |
| 4,182,084 | A | 1/1980 | Friedenberg | |
| 5,099,721 | A | 3/1992 | Decker et al. | |
| 5,499,943 | A | 3/1996 | Terris | |
| 5,573,120 | A | 11/1996 | Kaufmann | |
| 5,660,582 | A | 8/1997 | Terris | |
| 6,446,797 | B1 * | 9/2002 | Shiga | 206/303 |
| 7,238,096 | B2 | 7/2007 | Scott | |
| 8,267,752 | B2 * | 9/2012 | Chang | 451/419 |
| 2009/0075570 | A1 | 3/2009 | Levsen | |
| 2010/0011919 | A1 | 1/2010 | Creemers | |

* cited by examiner

*Primary Examiner* — Timothy V Eley
(74) *Attorney, Agent, or Firm* — Morriss O'Bryant Compagni

(57) ABSTRACT

Apparatus, systems and methods related to sharpening blades for rotary cutters. In one illustrative embodiment, a power sharpener system secures a rotary cutting blade between upper and lower columns that form a rotating axle in contact with upper and lower sharpening stones, each positioned at an appropriate angle to contact a cutting edges of the rotary blade for sharpening. The upper column may be rotatably attached to an upper cover or lid and the lower column rotatably disposed in a base. After the rotary blade is secured, an electric motor is used to rotate the column, contacting the edges of the blade against the stones to simultaneously sharpen both edges of the blade. In some embodiments, a retractable plate may be disposed around the lower column for placement of the rotary blade thereon and a lifting lever may be used to facilitate blade removal.

16 Claims, 7 Drawing Sheets

PORTABLE POWER SHARPENER FOR HAND HELD ROTARY CUTTER BLADES

TECHNICAL FIELD

The present invention relates to honers and sharpeners for blades, and in particular, to devices aid methods for sharpening blades for hand held rotary cutters.

BACKGROUND

Rotary cutters are used for cutting fabric in quilt making and hobby sewing, among other uses. Such rotary cutters come in many different designs, each of which includes a handle portion and a "wheel blade" or rotary cutting blade. The various designs for rotary cutters include differing handle shapes, for ease of use or user preference, with a rotary cutting blade rotatably mounted near one end. Various designs include differing blade guard features which are intended to reduce the potential for injury to a user.

The rotary cutting blades for such cutters typically come in three standard sizes, a 28 mm diameter rotary cutting blade, a 45 mm diameter rotary cutting blade, and a 60 mm diameter rotary cutting blade. One known problem with rotary cutters is the relatively high replacement cost of the blades for these popular fabric, craft, and hobby cutting tools. Additionally, as noted in the prior art, many rotary cutting blades lack perfect roundness.

Known sharpeners for rotary cutting blades include sharpeners for the large rotary blades of commercial cutters for meat slicing and the like, which are used with the motor driven blade of the cutter. Also, known are smaller manual sharpeners for hand held rotary cutters, such as those disclosed in U.S. Pat. Nos. 7,238,096, 5,660,582 and 5,499,943, the disclosures of each of which are incorporated by reference herein. However, these types of manual sharpener require the wheel blade to be removed from the cutter and secured within the device, following which the user rotates a portion of the device by hand to rub the cutting edge of the blade against an abrasive grit. This requires a significant effort on the part of the user, which may be problematic for some customers.

One attempt to address these shortcomings has resulted in the RBS-61 Rotary Cutter Blade Sharpener available from inventive Circles, LLC. However, such sharpener requires a rotary blade to be bolted to in place on an open top, then a rotating; head positioned thereover which rotates an abrasive disk against the blade, rotating the blade. A complete sharpening requires removing and replacing the blade to sharpen both edges twice, once with a "diamond disc", and once with an "ultrafine disc". Such a sharpener is relatively bulky and harder to transport. Further, the continual exposure of the rotary blade during sharpening and the additional handling of the blade required to complete sharpening increase the likelihood of injury to a user.

Accordingly there exists a need for assemblies and devices that address these problems. A system or assembly that allowed for a rotary blade to be honed or sharpened quickly with reduced chance of injury to a user would be an improvement in the art. Such a sharpener that was easily portable and relatively inexpensive would be further improvement in the art.

SUMMARY

Apparatus, systems and methods in accordance with the present invention are related to sharpening blades for rotary cutters. In one illustrative embodiment, a power sharpener system secures a rotary cutting blade between upper and lower columns that form a rotating axle in contact with upper and lower sharpening stones, each positioned at an appropriate angle to contact a cutting edge of the rotary blade for sharpening. The upper column may be rotatably attached to an upper cover or lid and the lower column rotatably disposed in a base. After the rotary blade is secured, an electric motor is used to rotate the column, contacting the edges of the blade against the stones to simultaneously sharpen both edges of the blade. In some embodiments, a retractable plate may be disposed around the lower column for placement of the rotary blade thereon and a lifting lever may be used to facilitate blade removal.

DESCRIPTION OF THE DRAWINGS

It will be appreciated by those of ordinary skill in the art that the elements depicted in the various drawings are not necessarily to scale, but are for illustrative purposes only. The nature of the present invention, as well as other embodiments of the present invention may be more clearly understood by reference to the following detailed description of the invention, to the appended claims, and to the several drawings attached hereto.

DESCRIPTION

Figure 1:
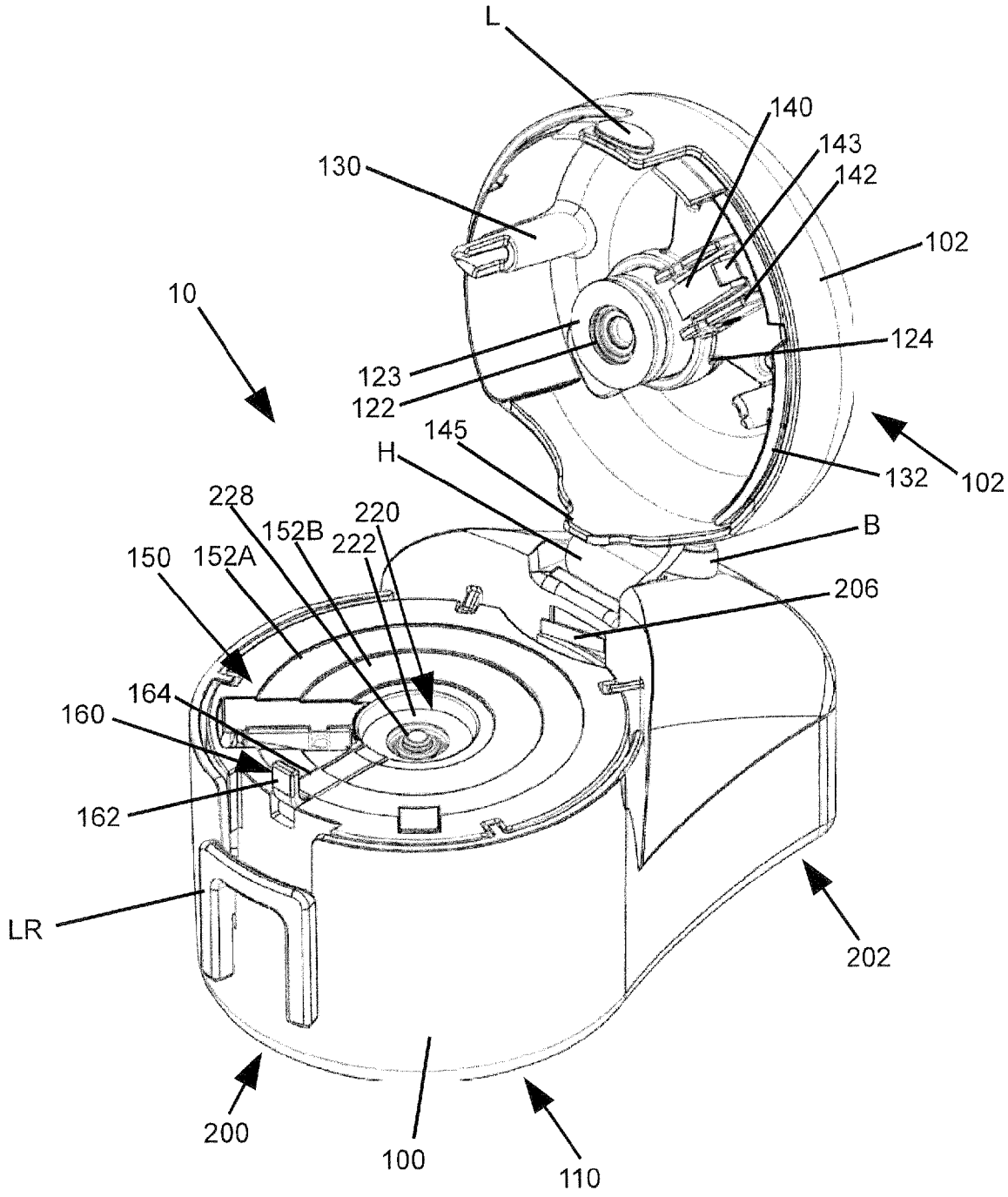
FIG. 1 is a perspective view of an illustrative embodiment of a power sharpening system in an open position in accordance with the principles of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

FIGS. 1 through 4 depict a first illustrative embodiment of a power sharpening assembly 10 in accordance with the principles of the present invention. An outer case 100 surrounds and contains the remaining components of the system 10 and includes an upper cap portion 102 which is connected by a hinge H to a lower portion 110. Upper cap portion 102 may be generally formed as a rounded sidewall and closed top forming an encircled wall having an open bottom. A securing latch L may extend from the sidewall as a protrusion that interacts with a corresponding latch receiver LR on lower portion 110.

Figure 6:
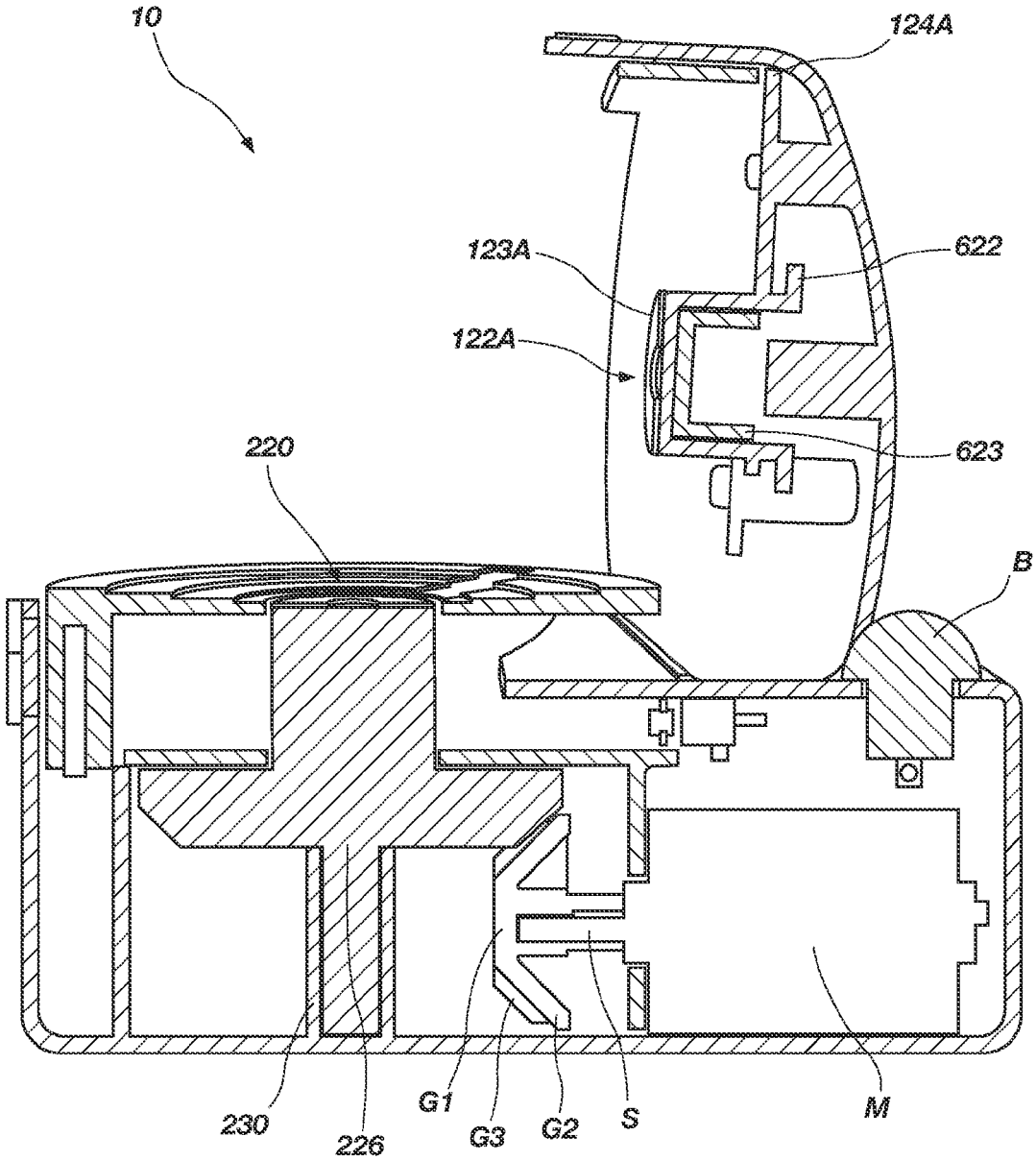
FIG. 6 is a side cutaway view of the embodiment of FIG. 5.

A number of structures are disposed in the well of upper cap portion 102. An upper column 122 is rotatably attached to the upper cap portion 102 by a mounting bracket 124. As depicted, in FIGS. 1 through 4, the upper column 122 and mounting bracket 124 may comprise an axle and bearing type of structure. Alternatively, as depicted in FIG. 6, upper column 122A may be formed as an outer member 622 with a circular planar bottom having encircling sidewall extending at a right angle from the edges thereof to an outer flange 624, which is disposed on a hub 623, on which it can be rotated, and protrudes through a hole in the mounting bracket 124A face, retained thereon by the flange 624. A circular pad 123 formed of a resilient material, such as a silicone or rubber may be mounted on the face of the upper column 122 for contacting the surface of an inserted rotary blade. It will be appreciated that although depicted as having a rounded cross section, a structure having any cross sectional shape may be used so long as it can be rotated.

Structures for aligning the upper cap portion 102 with lower portion 110 when the system 10 is closed are also disposed on the upper cap portion 102 and include alignment rods 130A and 13AB extending from the closed top of upper cap portion 102. These rods may be hollow rod, such as rod 130 which has a lower opening (which may be formed by an extension of only a portion of the rod 130) Upon closure, alignment rod 130 may receive a corresponding column located within lower portion 110 within its open bore to facilitate accurate alignment of the upper and lower portions. Alternatively, the rod may be a solid protrusion, having a polygonal, rounded, or other cross sectional shape, which is received in a corresponding receiver in the lower portion 110.

Additionally, in some embodiments, the alignment rod 130 interaction with a lower column may engage a cut-off switch to complete a circuit that allows the sharpener 10 to be operated, but prevents operation when the sharpener is open. It will be appreciated that in other embodiments, a cutoff switch which completes a circuit that allows the sharpener 10 to be operated, but prevents operation when the sharpener is open, may be constructed in other manners. For example, in FIG. 1, a closure tab 145 disposed at the rear surface of the sidewall of upper portion 202 presses push bar 206 into recess of the sidewall at the rear of the front section 200 of tower portion 110, engaging a switch.

Additional alignment structures may include one or more alignment flanges 132, formed as extensions of the outer rim of upper cap portion 102 sidewall that reside inside the sidewall of lower portion 110 upon closure. Alignment flanges 132 may encircle a portion of the upper cap portion 102 and may includes one or more notches that correspond to tabs 152 inside the sidewall of lower portion 110 for increased accuracy of alignment. In addition to facilitating alignment, the flanges 132 may contact retractable plate 150, pushing it downwards and allowing sharpening of an inserted rotary blade to occur, as discussed in further herein.

Also disposed in the upper cap portion 102 is upper sharpening stone 140 which is removably disposed in upper stone mounting bracket 142, which may be formed as a portion of mounting bracket 124. As depicted, upper sharpening stone 140 may be formed as an elongated member having a square cross section that may be placed in the upper stone mounting bracket 142, as between a fixed end clip at first end and a movable end clip or lever 143 at the opposite longitudinal end, or as in a recess formed by a first wall or clip at a first end together with opposite walls along the long edges thereof and retained therein by an end clip or lever at the second longitudinal end. Upon installation, one side of the stone is exposed towards the open bottom of upper cap portion 102, at an angle A measured against a plane parallel to the surface of the face of upper column 122. Angle A, when measured against the general plane of the base may be from about 5 to about 15 degrees, depending on the embodiment. In the depicted embodiment, the angle is at about 11 degrees and corresponds to the angle of the cutting edge of a rotary cutter blade. Upper sharpening stone 140 may be a natural or synthetic stone suitable for sharpening a blade, as known to those of ordinary skill in the art. It will be appreciated that by using an upper sharpening stone 140 with a square cross-section, as the exposed side of the stone is worn down by use, a user may rotate the stone in the mounting bracket 142 (by removing and replacing the stone) to allow all sides of the stone to be equally used.

Figure 2:
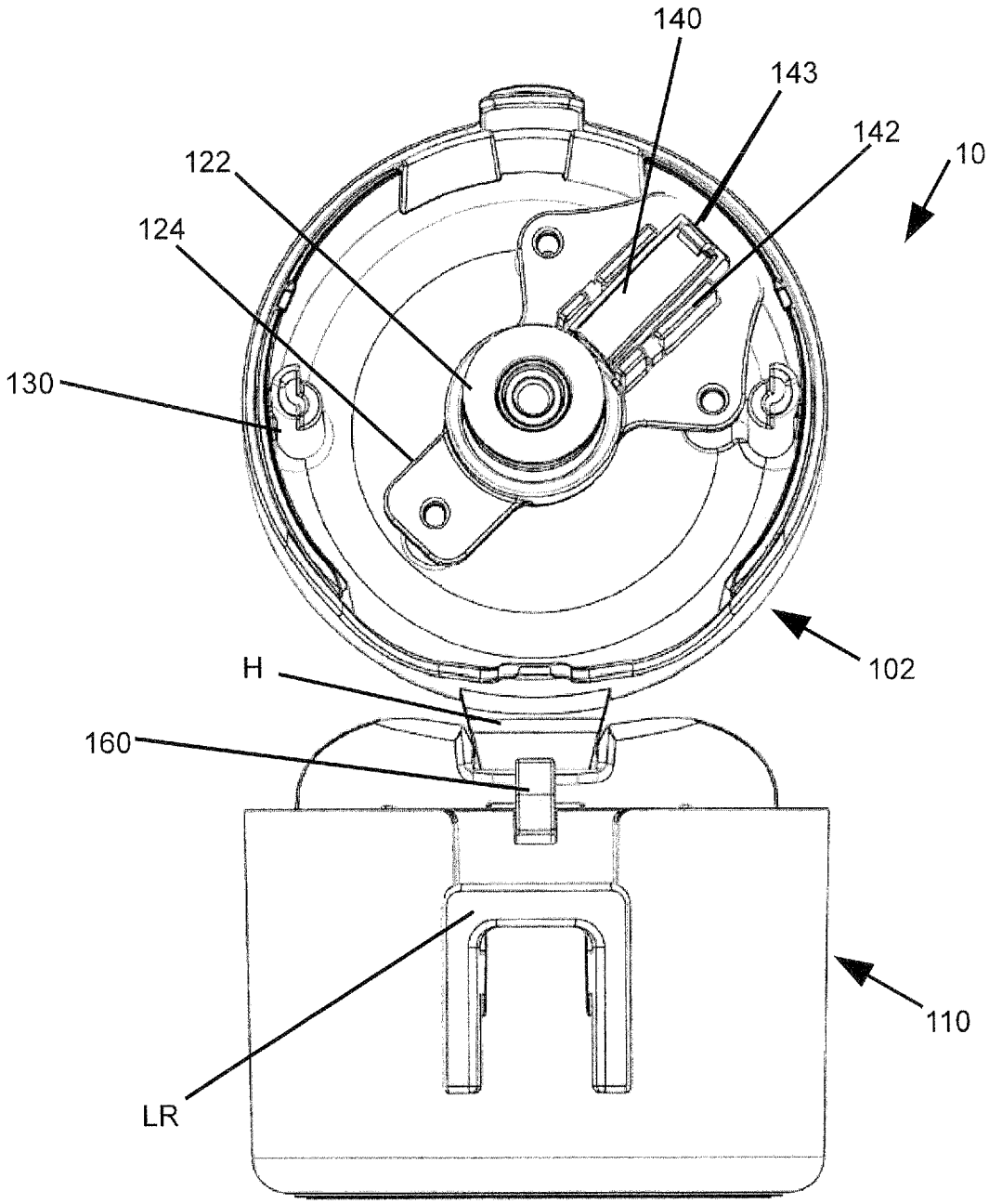
FIG. 2 is a front view of the embodiment of FIG. 1.

It will be appreciated that, as best depicted in FIG. 2, the upper stone mounting bracket 142 may be disposed on mounting bracket 124. In other embodiments, upper stone mounting bracket may be independently disposed in the upper cap portion 102 on a separate bracket.

Lower portion 110 of outer case 100 includes a rounded front portion 200, which may be generally formed as a rounded sidewall and a closed bottom forming an encircled will having an open top, and a rear portion 202 which may be formed as an enclosed box of a desired shape attached to the front portion 200. Latch receiver LR may be disposed on the front outer sidewall of front portion 200 for receiving latch L disposed on upper portion to secure the upper and lower portions in a closed position. Hinge H is attached to the rear portion 202, which may include a recess in the top thereof for receiving hinge H or the rear surface of upper portion 102 when in an open position. An actuation switch, such as button 204 may be disposed in the rear portion 202, as may be a receiving socket for a power cord.

Figure 3:
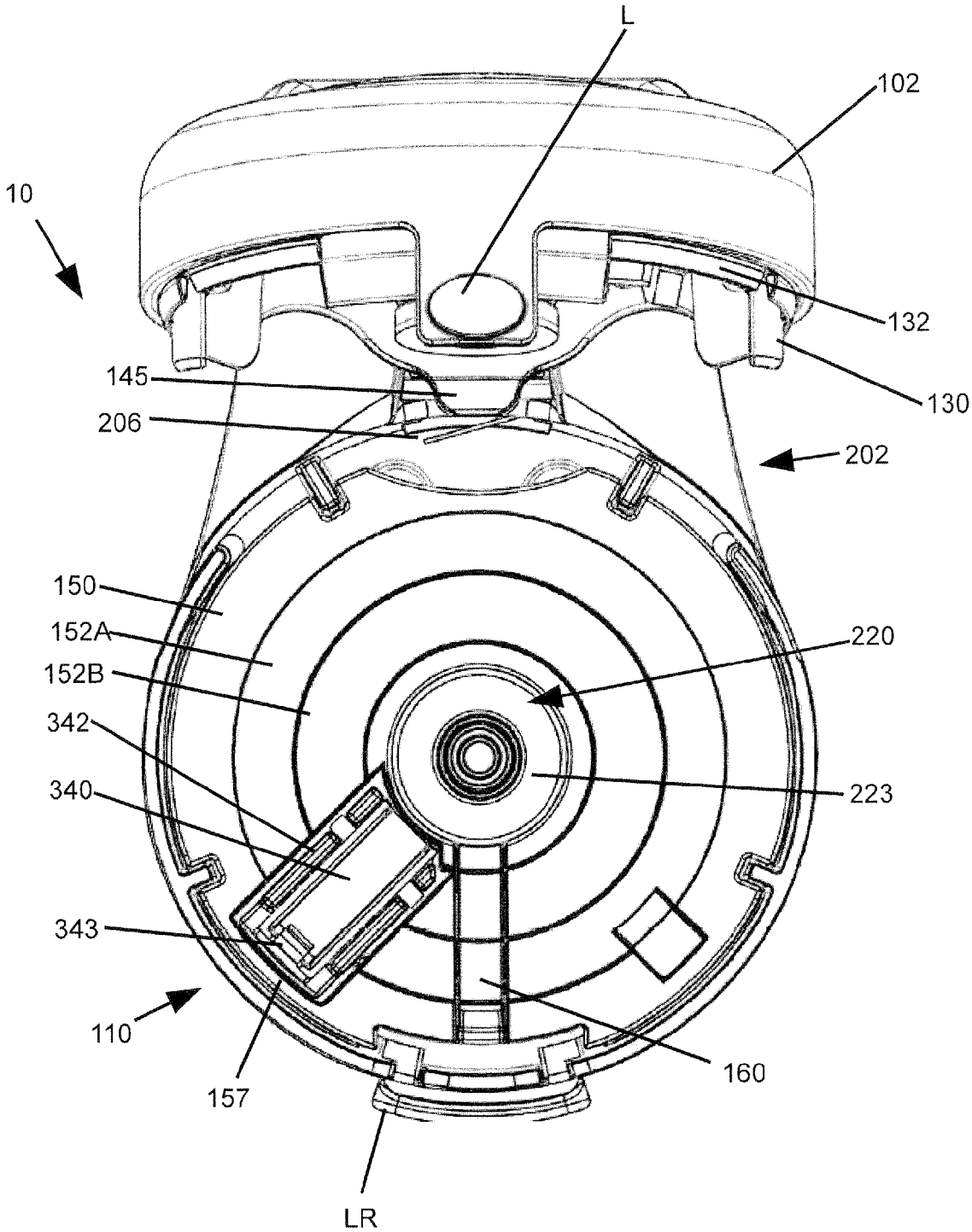
FIG. 3 is a top view of the embodiment of FIG. 1.
Figure 4:
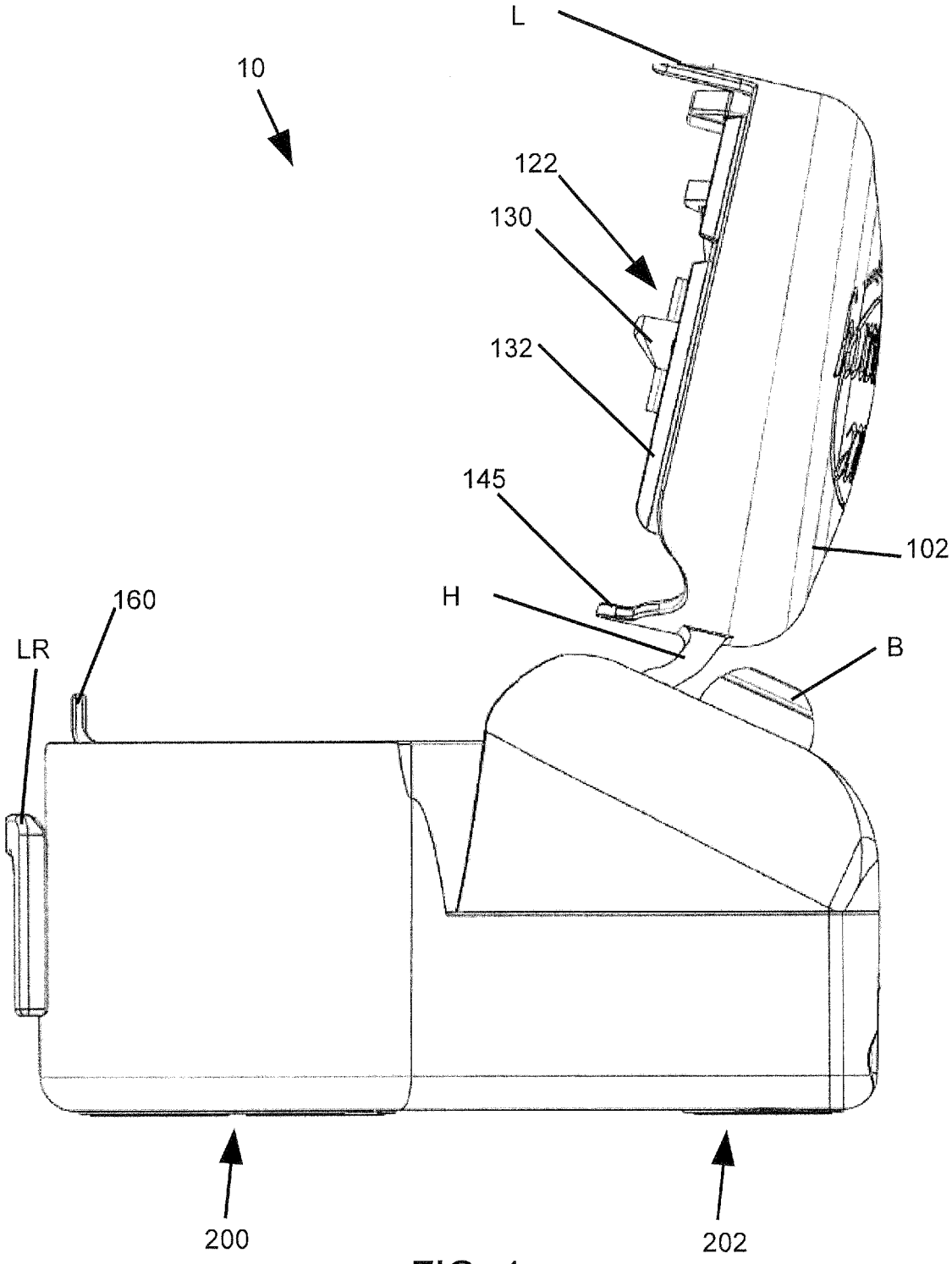
FIG. 4 is a side view of the embodiment of FIG. 1.

A retractable plate 150 is disposed within the open portion of the front section 200 of lower portion 110. As depicted in FIGS. 1 and 3, the upper surface of the retractable plate 150 may be formed as a generally planar surface having a series of rounded downward steps of decreasing size. Each step 152 may be formed by a planar circular flat portion with an outer sidewall rise to the adjoining outer step. The spacing between the steps may correspond to the two standard sizes of rotary cutting blades, for handheld rotary cutters, for example the inner step 152B may hold a 45 mm diameter rotary cutting blade on the flat portion thereof within its encircling sidewall while ringing step 152A may hold a 60 mm diameter rotary cutting blade on the flat portion thereof within its encircling sidewall. Rotary cutting blades of differing diameters may be placed on the rotary plate 150 on whichever step 152 they fit into or on the retractable plate above the indicated steps, so long as the diameter falls within the coverage of the sharpening stones.

A lifting lever generally indicated at 160 in FIG. 1, may be disposed in the retractable plate 150 to facilitate removal of a rotary blade after sharpening. As depicted lifting lever 160 may be formed as a member having a vertical portion 162 near an edge of retractable plate 150, which is joined to a horizontal portion 164 corresponding to the upper surface of retractable plate 150. The horizontal portion 164 of lifting lever 160 lies within an opening in the retractable plate 150 and the surface of the horizontal portion may match the upper surface of retractable plate 150 by completing the steps 152. Lifting lever 160 may be hingedly attached to the retractable plate 150, as by a hinge pin near the transition of vertical portion 162 and horizontal portion 164, in order to allow lever 160 to be rotated by pressing the vertical portion 162 forwards and down, thereby raising the horizontal portion 164 to tip and lift a rotary blade disposed thereover.

Figure 5:
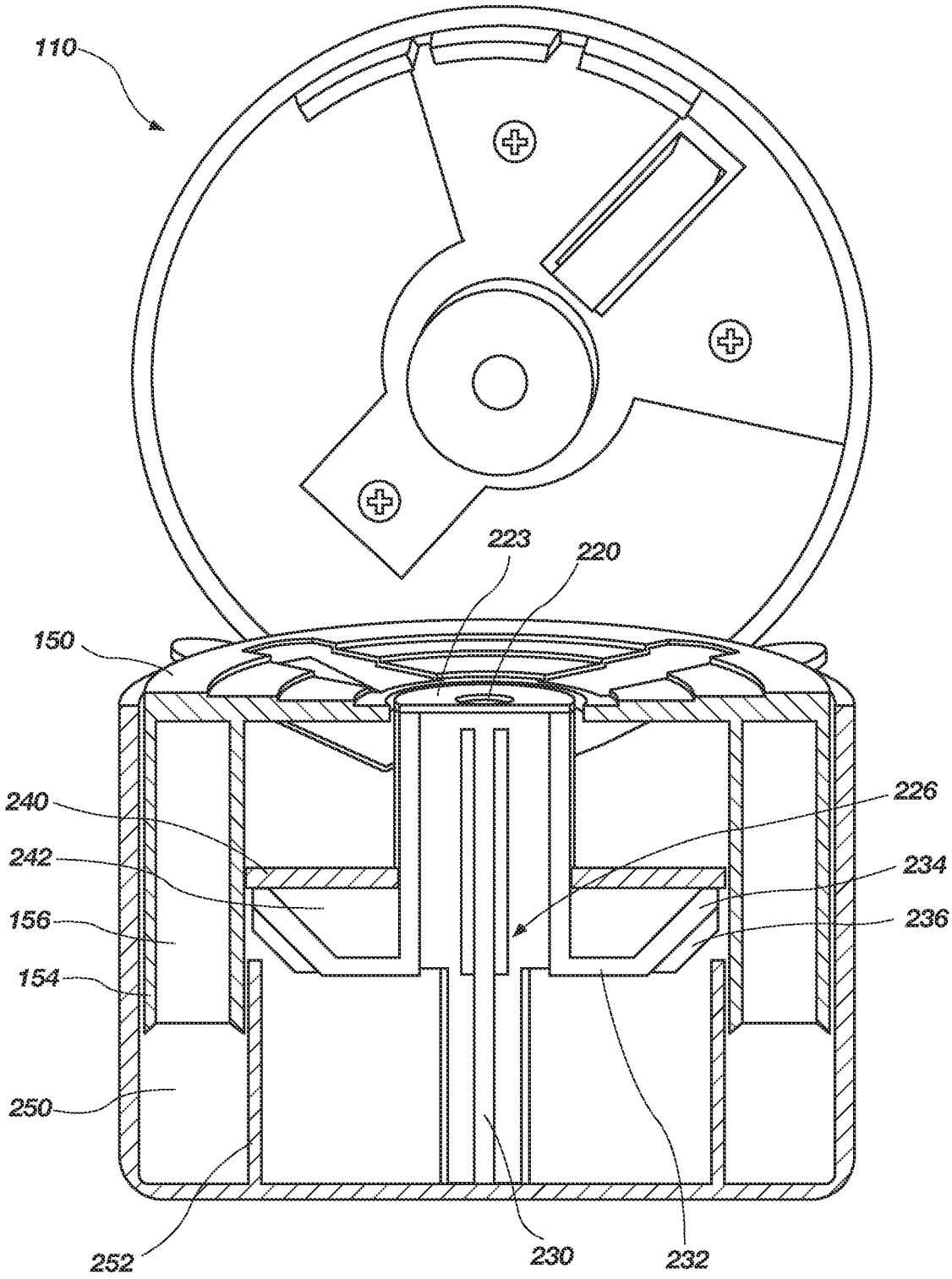
FIG. 5 is a front cutaway view of an alternative embodiment of a power sharpening system in accordance with the principles of the present invention.

As best depicted in cross-sectional views of FIGS. 5 and 6, system 10 includes a number of features at least partially disposed in the interior of lower portion 110. A lower column 220 is disposed in a central hole in retractable plate 150 to expose the top surface 222 thereof. As with upper column 122, a circular pad 223 formed of a resilient material, such as a silicone or rubber may be mounted on the face of the lower column 220 for contacting the surface of an inserted rotary blade. It will be appreciated that although depicted as having a rounded cross section, a structure having any cross sectional shape may be used so long as it can be rotated. In some embodiments, the face of either lower column 220 or upper column 122 may include a projection that pass through the central hole of an inserted rotary blade and enters a corresponding receptacle on the opposite column upon closure to facilitate alignment.

The top surface 222 of lower column 220 may be disposed coplanar with the top surface of the retractable plate 150 or at a lower point to enable a user to place a rotary blade on the retractable plate. Where a projection (228. FIG. 1) is present on the top surface of lower column 220, it may project past the retractable plate 150 to facilitate alignment.

From top surface 222 to a junction point 226 underneath the retractable plate 150, lower column 220 may have a first portion with a relatively thicker cross section that corresponds to the central hole in retractable plate 150. From junction point 226 to a lower end, the lower column 220 may comprise a shaft having a relatively narrower cross section (in comparison to the upper portion) which may be disposed in a receiver 230 which may comprise a column disposed on the bottom surface of the lower portion 110 that has a bore in which the shaft rotates.

Extending from the thicker first portion of lower column 220 near junction point 226 is a radial flange 232 which enables the rotation of lower column 220 to be driven. In depicted embodiment, a medial section of the radial flange 232 extends laterally outward from the column 220 and a slanted portion 234 extends upwards at an angle from the medial section. As best depicted in FIG. 5, the outer surface of the slanted portion 234 may include a series of ridges 236, which are spaced apart at regular intervals to allow the rotation to be driven. A medial shelf 240 which may include a lower shaped guide portion 242 or a separate shelf and guide may be used to maintain the column 220 in proper position.

As best depicted in FIG. 6, an electric motor M having a shaft S is used to drive a gear element G1, having a slanted portion G2 and a series of ridges G3 that correspond to the slanted portion 234 and spaces between the ridges 236 of the medial flange 232 to rotate the lower column 220. Presently, some embodiments use a nine volt motor which rotates the column 220 at a speed of approximately 600 RPM, although it will be appreciated that a motor having a different voltage or rotating the column at a different speed may be used, provided such motor and speed are sufficient to sharpen an inserted rotary blade. It will be appreciated that the motor may be provided power through a cord plugged into a receiving socket disposed in the case 100, which may be attached through a transformer to a standard electrical outlet, or that a suitable battery or battery series may be used as known to those of skill in the art.

Beneath its generally planar upper surface, retractable plate 150 has support structures that allow it to retract into bottom portion 110 when top portion 102 is closed and elevate when top portion 102 is opened. On either side of the retractable table 150, a columnar leg 156 may extend downwards from the upper planar member. As depicted each leg 156 may be a hollow column formed from a surrounding sidewall 154 and may have an open or closed bottom. The lower end of each leg 156 is received in a receptacle 250 formed by a wall 252 projecting upwards from the bottom of the bottom portion 110 and the sidewall of the bottom portion 110. The legs 156 are spaced outwards of the medial flange 230 of the lower column. A resilient member such as a spring may be disposed in the front portion of the bottom portion in contact with the retractable plate to urge the plate to an elevated position when the system 10 is open. For example, in some embodiment, such resilient members may be at least partially disposed in the receptacles 252 to provide an upwards force on the legs 156.

Also disposed in the lower portion 110 is lower sharpening stone 340 which is removably disposed in lower stone mounting bracket 342. Stone opening 157 is present in retractable table 150 and allows retractable table 150 to retract past the lower stone and bracket during operation. As depicted, lower sharpening stone 340 may be formed as an elongated member having a square cross section that may be placed in the upper stone mounting bracket 342, as between a fixed end clip at first end and a movable end clip or lever 343 at the opposite longitudinal end, or as in a recess formed by a first wall or clip at a first end together with opposite walls along the long edges thereof and retained therein by an end clip or lever at the second longitudinal end. Upon installation, one side of the stone is exposed towards the open upper end of lower portion 110, at an angle B measured against a plane parallel to the surface of the face of lower column 220. Angle B, when measured against the general plane of the base may be from about 5 to about 15 degrees, depending on the embodiment. In the depicted embodiment, the angle is at about 11 degrees and corresponds to the angle of the cutting edge of a rotary cutter blade. Lower sharpening stone 340 may be a natural or synthetic stone suitable for sharpening a blade, as known to those of ordinary skill in the art. It will be appreciated that by using an lower sharpening stone 340 with a square cross-section, as the exposed side of the stone is worn clown by use, a user may rotate the stone in the mounting bracket 342 (by removing and replacing the stone) to allow all sides of the stone to be equally used.

It will be appreciated that upper stone 140 and lower stone 340 may be disposed at any desired angle with respect to one another that facilitates placement in a system 10 in accordance with the present invention. For example, in the embodiment depicted in FIGS. 1 through 4, the stones are offset from one another in an angle of approximately 90 degrees measured around the rotational axis of the system, while in the embodiment depicted in FIGS. 5 and 6, the stones are offset from one another in an angle of approximately 180 degrees measured around the rotational axis of the system.

Figure 7:
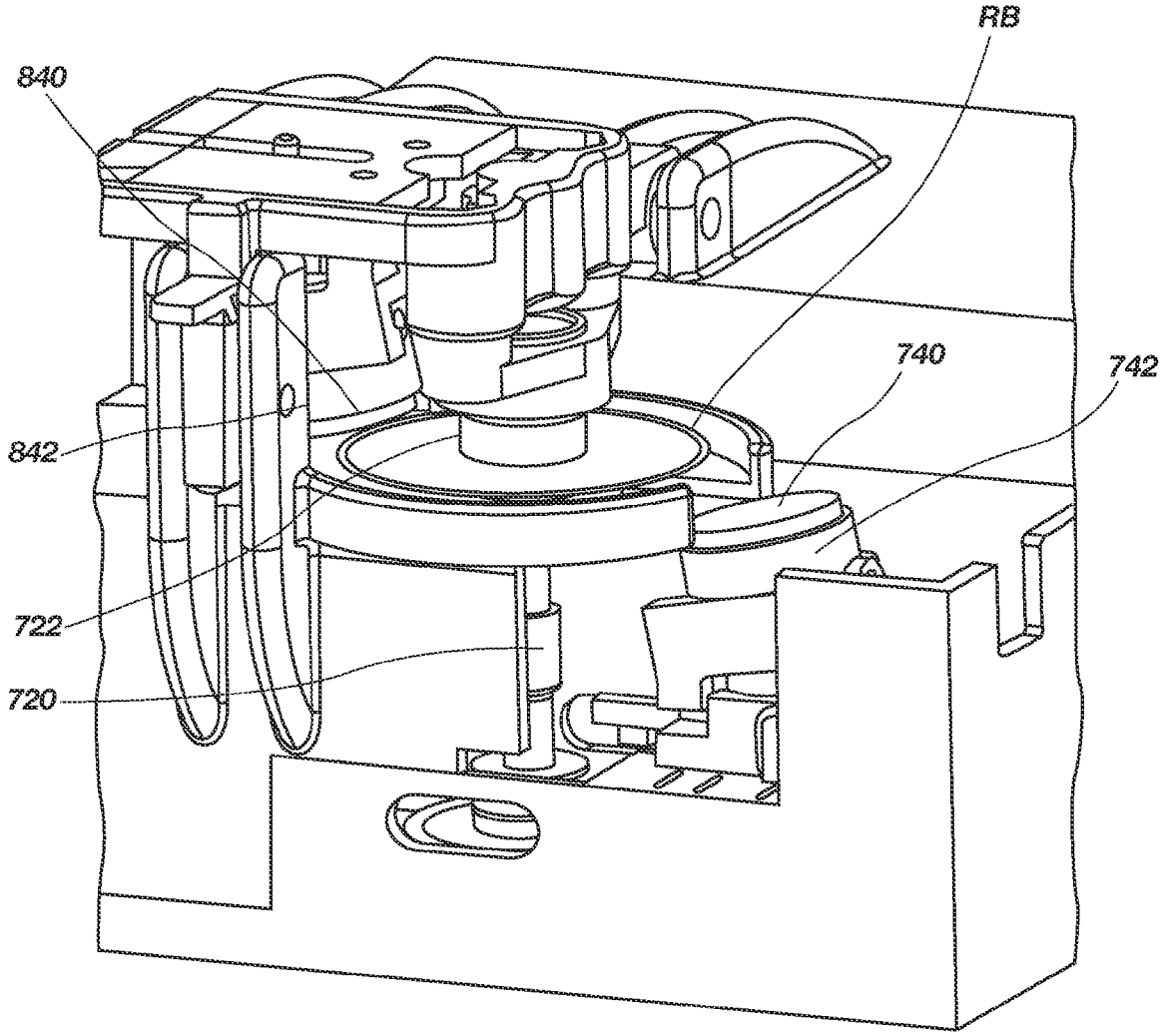
FIG. 7 is a front perspective view of another alternative embodiment off portion of a power sharpener with the present invention.

FIG. 7 depicts an alternative mechanism for a sharpener system in accordance with the present invention which has a rotary blade RB disposed in the axle formed by upper column 722 and lower column 720, and uses sharpening stones having a circular cross section and planar lower and upper faces. Such stones, 740 and 840 are mounted in mounting brackets 742 and 842 having a circular stone holding portion. In some embodiments of this type, the stones may be rotated by rotation of, or in, the mounting brackets during sharpening in order to obtain even wearing on the top surface of the stone. In other embodiments, a user may manually rotate the stones between sharpening as desired to obtain even wear. In either type of embodiment, the stones may be removed from the mounting brackets and replaced to expose the former lower surface as the new upper surface to allow both planar sides of the stone to be equally used.

In operation, a user inserts a rotary blade for a hand held rotary cutter which needs to be sharpened into an open system 10 in accordance with the present invention by placing the rotary blade on or over the top surface 22 of the lower column 220, as by placing the blade on the retractable plate 150 within a suitable step 152 centered over the lower column 220. The upper portion 102 or cap of the system 10 is then closed, by rotating the upper portion on hinge H and engaging latch L with latch receiver LR. The alignment structures of the upper and lower portions engage to provide a proper alignment that brings the rotational axis of upper column 122 in alignment with that of lower column 220, as the face of upper column 122 engages the upper surface of the rotary blade. Where present, the retractable plate 150 is retracted as it is pushed downwards by the structures in the upper portion 102 and cutoff switch 206 is engaged to allow the motor M to be engaged.

The inserted rotary blade is now held in a rotating axle formed by the upper column 122 and lower column 220 and the cutting edge thereof is in contact with the upper and lower sharpening stones, at an appropriate angle for sharpening. The user then actuates button B to engage the motor M, causing the rotating axle to rotate and sharpening the blade. In some embodiments, actuation of the button B engages an automatic cycle, in which the blade is rotated against the stones for a fixed amount of time set in a control circuit to sharpen or hone the blade as desired. For example, a shorter sharpening cycle may be selected, or a longer honing cycle may be used where the cutting edge is nicked or the blade has strayed from the ideal planar shape to an unsuitable degree. In other embodiments, the button may simply engage the motor while pressed allowing the user individual control over the process.

After the sharpening process is complete, the user opens the system 10 by releasing latch L from latch receiver LR and rotating top portion 102 upwards. Lifting lever 160 may then be used to tip up the exposed rotary blade for removal from the system 10 and replacement in a hand held rotary cutter.

While the present invention has been shown and described in terms of preferred embodiments thereof, it will be understood that this invention is not limited to any particular embodiment and that changes and modifications may be made without departing from the true spirit and scope of the invention as defined and desired to be protected.

What is claimed is:

1. A powered sharpening system for sharpening a rotary cutting blade for a hand held rotary cutter, comprising:

a case having an upper cap portion and a lower body portion;

an upper rotary column with a bottom face disposed in the upper cap portion of the case;

a lower rotary column with an upper face disposed in the lower body portion of the case, the upper and lower columns disposed to come together along a common rotary axis with a rotary cutting blade disposed between the bottom face of the upper rotary column and the upper face of the lower rotary column when the case is in a closed position;

an upper sharpening stone disposed in the upper cap portion of the case and positioned at an appropriate angle to contact an upper cutting edge of the rotary cutting blade disposed between the bottom face of the upper rotary column and the upper face of the lower rotary column when the case is in a closed position;

a lower sharpening stone disposed in the lower body portion of the case and positioned at an appropriate angle to contact a lower cutting edge of the rotary cutting blade disposed between the bottom of the upper rotary column and the upper face of the lower rotary column when the case is in a closed position; and a motor for rotating the upper and lower rotary columns to sharpen the rotary cutting blade disposed between the bottom face of the upper rotary column and upper face of the lower rotary column when the case is in a closed position.

2. The powered sharpening system of claim 1, further comprising a retractable plate disposed in the lower body portion of the case, which is in an elevated position when the case is open and retracts when the case is closed.

3. The powered sharpening system of claim 2, wherein the retractable plate comprises at least one recessed step in an upper surface thereof for receiving a rotary cutting blade to thereby align a central aperture in the blade with the lower rotary column.

4. The powered sharpening system of claim 2, wherein the retractable plate further comprises a lifting lever formed as a pivoting member disposed therein which may be pivoted to elevate a portion of a rotary cutting blade placed on the retractable plate.

5. The powered sharpening system of claim 2, wherein the retractable plate is pushed to a retracted position by at least one flange disposed on an edge of the upper cap portion of the case, when the case is placed in a closed position.

6. The powered sharpening system of claim 1, wherein the upper cap portion and lower body portion of the case are connected by a hinge.

7. The powered sharpening system of claim 1, wherein a latch structure formed as a projection on the upper cap portion interacts with a latch receiving structure on the lower body portion to secure the case in a closed position.

8. The powered sharpening system of claim 1, wherein the upper rotary column with the bottom face disposed in the upper cap portion of the case is rotatable attached within the upper cap portion through a mounting bracket.

9. The powered sharpening system of claim 1, wherein the lower rotary column with the upper face disposed in the lower body portion of the case has a lower shaft that is rotatably disposed in a receiver formed in the lower body portion in which the lower column rotates and includes a projecting shelf having a series of ridges that enable the lower column to be rotated by a complementary gear.

10. The powered sharpening system of claim 9, further comprising a gear member disposed on a shaft of the motor and in contact with the projecting shelf of the lower column to rotate the lower column and the upper column upon activation of the motor.

11. The powered sharpening system of claim 1, wherein the upper sharpening stone disposed in the upper cap portion of the case comprises an elongated stone having a square cross-sectional shape.

12. The powered sharpening system of claim 1, wherein the upper sharpening stone is positioned at an angle of from about 5 to about 15 degrees relative to the plane of an inserted rotary blade, when the case is in a closed position.

13. The powered sharpening system of claim 1, wherein the lower sharpening stone disposed in the lower body portion of the case comprises an elongated stone having a square cross-sectional shape.

14. The powered sharpening system of claim 1, wherein the lower sharpening stone is positioned at an angle of from about 5 to about 15 degrees relative to the plane of an inserted rotary blade.

15. The powered sharpening system of claim 1, wherein the upper sharpening stone and the lower sharpening stone are each removably disposed in a bracket from which the stone may be removed and replaced in a rotated position to present a different side of each respective stone to an inserted rotary blade.

16. The powered sharpening system of claim 1, wherein the upper sharpening stone and the lower sharpening stone are positioned at an angle from one another measured around the rotational axis of the lower column selected from the group of 180 degrees and 90 degrees.

* * * * *